US007296630B2

(12) United States Patent
Severin et al.

(10) Patent No.: US 7,296,630 B2
(45) Date of Patent: Nov. 20, 2007

(54) HANDS-FREE BAIL-ELEVATOR LOCKING DEVICE WITH COMBINED POWER/CONTROL CONNECTOR, BAIL SPREADER AND METHOD FOR USE

(75) Inventors: Iwo Severin, Luebeck (DE); Jens Lutzhoeft, Hamburg (DE); Jörn Grotherr, Halstenbek (DE)

(73) Assignee: Blohm + Voss Repair GmbH, Hamburg (DE)

( * ) Notice: Subject to any disclaimer, the term of this patent is extended or adjusted under 35 U.S.C. 154(b) by 276 days.

(21) Appl. No.: 11/066,767

(22) Filed: Feb. 25, 2005

(65) Prior Publication Data

US 2006/0191690 A1 Aug. 31, 2006

(51) Int. Cl.
*E21B 19/06* (2006.01)
*B66C 1/28* (2006.01)

(52) U.S. Cl. ..... 166/379; 166/380; 166/77.52; 294/102.2; 414/22.51

(58) Field of Classification Search ..... 166/379, 166/380, 77.52, 77.1, 77.14; 294/5.5, 82.19, 294/110.1, 102.2, 68.27, 91; 414/22.51; 175/162

See application file for complete search history.

(56) References Cited

U.S. PATENT DOCUMENTS 1,086,772 A * 2/1914 Hoxie ..... 294/68.27
3,063,509 A 11/1962 Guier
3,365,081 A * 1/1968 McLerran ..... 414/22.51
4,389,760 A 6/1983 Krasnov
4,421,447 A 12/1983 Gudgel et al.
4,492,134 A 1/1985 Reinholdt et al.
4,625,796 A 12/1986 Boyadjieff
4,709,766 A 12/1987 Boyadjieff
4,765,401 A 8/1988 Boyadjieff
4,793,422 A 12/1988 Krasnov
4,800,968 A 1/1989 Shaw et al.
5,340,182 A 8/1994 Busink et al.
5,909,768 A 6/1999 Castille et al.
6,237,684 B1 5/2001 Bouligny, Jr. et al.
6,309,002 B1 10/2001 Bouligny
6,386,283 B1 5/2002 Mosing et al.

(Continued)

FOREIGN PATENT DOCUMENTS

DE 3636130 C1 * 1/1988

(Continued)

*Primary Examiner*—Kenneth Thompson
(74) *Attorney, Agent, or Firm*—Gary L. Bush; Brett T. Cooke; Andrews Kurth LLP

(57) ABSTRACT

A method and apparatus for raising or lowering a tubular in a well wherein bails are conventionally coupled to elevator ears and locking assemblies secured to the outer sides of the lower bail eyes for remote controlled clamping to nipples integral with and extending from the elevator ears. The locking assemblies contain upper and lower jaws which, by a remotely controlled actuator, move in linear relation to each other and have concave clamping surfaces which join together to form a circular opening for receiving the elevator ear nipples. The nipples have enlarged diameters at their distal ends to prevent removal from the closed jaws. A remotely controlled link spreading mechanism spreads the bails to accommodate an elevator. Elevator ears may contain internal conduits for communication of power and control signals between the suspended elevator and the bails. The passages mate with a remotely actuated connector assembly.

21 Claims, 14 Drawing Sheets

U.S. PATENT DOCUMENTS 6,443,241 B1 9/2002 Juhasz et al.
6,520,709 B1 2/2003 Mosing et al.
6,557,641 B2 5/2003 Sipos et al.
6,568,479 B2 5/2003 Mosing et al.
6,637,526 B2 10/2003 Juhasz et al.
6,915,868 B1 * 7/2005 Mosing et al. ..... 175/423
2006/0027375 A1 * 2/2006 Thomas et al. ..... 166/380

FOREIGN PATENT DOCUMENTS

EP 560607 A1 * 9/1993

* cited by examiner

HANDS-FREE BAIL-ELEVATOR LOCKING DEVICE WITH COMBINED POWER/CONTROL CONNECTOR, BAIL SPREADER AND METHOD FOR USE

BACKGROUND OF THE INVENTION

1. Field of the Invention

This invention relates generally to drilling equipment used particularly in the hydrocarbon production industry and specifically to a method and apparatus for mechanized coupling and locking of bails to elevator ears and the concomitant coupling of power and control circuits between the bails and the suspended elevator.

2. Description of the Prior Art

In the hydrocarbon production industry, tubular goods, including drill strings, casings and tubing and often referred to simply as tubulars, must at varying stages be run, i.e. lowered, into or raised from a well. Elevators are devices which support the tubular for the purpose of raising or lowing it. An elevator may clamp along the side of a tubular using slips and dies to exert a radial clamping force on the tubular wall, or an elevator may use a bushing to support the tubular at the lower lip of a box connector. The latter method is preferable for deep water production as a slip can exert damaging crushing forces on the tubular under high hook loads.

FIGS. 1 and 2 show one typical elevator setup of prior art where an elevator (10) is suspended from a top drive mechanism (9) by a pair of bails, or links (14), which have eyes (16, 18) at both ends. The top drive mechanism (9) is in turn suspended by a traveling block (12) and wire rope (19) rigged from a crown block (not shown) located in the top of the drilling rig. The upper eyes (16) of the pair of bails (14) are hooked to the link supports (20) of the top drive (9), and the lower eyes (18) of the pair of bails (14) are hooked to the ears (22) protruding from the elevator (10). The bails (14) are secured to the elevator ears (22) by locking mechanisms (25) to prevent the bails (14) from inadvertently becoming uncoupled from the elevator (10). The elevator (10) and the supported tubular (24) are thus raised and lowered by the traveling block (12)/top drive (9) and bails (14). All the components in this series are designed to carry the expected loads.

The top drive (9) is used in place of a conventional rotary table and Kelly bushing to rotate the tubular during rotary drilling. Using hydraulic or electric motors (11) and a gear train (13) suspended above the drill string (24) enables the drill string to be rotated continuously while being lowered into or raised from a well. The top drive mechanism slides up and down along frame members (15) to check rotation of the top drive in reaction to the spinning of the tubular (24) while allowing free vertical movement of the device. Although a top drive mechanism (9) is shown in FIGS. 1-2, an elevator may alternatively be suspended directly from the traveling block (12) using links (14). In this case, the drilling platform is preferably equipped with a rotary table.

A spider, much like an elevator, is a device which holds a tubular to prevent it from descending into a well when it is not held by an elevator. Unlike an elevator, however, the spider is designed to remain on the drilling deck and is not moved vertically. When the elevator, connected to the traveling block, nears its high limit of travel (when raising a tubular) or its low limit or travel (when running a tubular), it must be repositioned in order to continue the operation. The spider holds the tubular prior to the elevator releasing the tubular. Thus, the tubular is held in place while the elevator is repositioned. Once the elevator holds the tubular at a new location, the spider is disengaged allowing the tubular to freely pass through the spider or for the spider to be moved completely clear of the tubular.

It is common practice to use a first elevator as a temporary substitute for a spider to support a tubular and a second elevator, coupled to the traveling block, to lower the tubular string. When the second traveling elevator is holding the tubular, the first elevator is moved clear of the tubular. The second elevator and tubular are lowered. When the second elevator has been lowered to the rig floor, the bails are removed from the second elevator and attached to the nearby first elevator. The second elevator now acts as the spider, while the first elevator is repositioned towards the top of the string where it is clamped to the tubular. The second elevator releases the tubular and is moved clear of the tubular, and the first elevator lowers the tubular into the well. When the first elevator reaches the rig floor, the elevators are again swapped in a process sometimes referred to as circulating the elevators. The same process is used in a reverse sequence for raising a tubular. Because both elevators change their location continuously during this process, there is no need for elevator/spider differentiation.

In the prior art, coupling the bails to the elevators is done in a time-consuming labor-intensive manual process. Extreme care must be taken when working with the heavy bails in order to avoid possibly severe injury to the rigger. Further, each bail must be securely fixed to the corresponding elevator ear, requiring another time-consuming step in the rigging process of manually engaging a locking device. A method to automate the repeated coupling, locking, unlocking, uncoupling of bails and elevators is desirable.

Further, many elevators used today employ powered internal mechanisms, e.g., power doors and/or power slips. When circulating the elevators, power and control lines to the elevators can interfere with deck operations, becoming entangled or snagging on objects. However, uncoupling and re-coupling supply and control lines is also a burdensome manual process, particularly if the elevator is hydraulically operated. A method which simplifies the supply of power to the elevators when circulating the elevators is desirable.

3. Identification of Objects of the Invention

A primary object of the invention is to provide a method and apparatus for increasing the efficiency of drilling operations by automating the process of connecting and locking bails or links to an elevator.

Another object of the invention is to provide a method and apparatus which prevents the need for riggers or other personnel to manually operate the bails or the elevator for coupling or uncoupling the two.

Another object of the invention is to provide a method and apparatus for providing power and control to a suspended elevator in a manner which does not cause power or control lines to hamper or otherwise interfere with deck operations.

Another object of the invention is to provide a method and apparatus for automatically coupling and uncoupling power and control lines to an elevator when the elevator is coupled or uncoupled to bails or links.

Another object of the invention is to promote operator safety by providing for total hands-free operation of the elevator.

SUMMARY OF THE INVENTION

The objects identified above, as well as other features and advantages of the invention are incorporated in a method and apparatus for raising or lowering a tubular in a well. One embodiment preferably includes an elevator for holding a tubular and designed to be suspended from a traveling block or a top drive mechanism by a pair of bails or links. The bails have eyes for being conventionally coupled to elevator ears which extend from the elevator, and additionally, the bails each have a locking assembly, secured to the outer side of the lower bail eye, which clamps to the distal end of the elevator ear for capturing the ear within the eye of the bail without the need for manual handling by riggers or other personnel. Each bail locking assembly contains upper and lower jaws having concave clamping profiles which join together to form a generally circular opening. The upper and lower jaws move in linear relation to one another. When the upper and lower jaws abut, they clamp tightly around a nipple which protrudes from the distal end of the elevator ear. The nipple has a radially extending protuberance at the tip which is larger in diameter than the circular opening formed by the closed jaws which prevents the captured nipple from being pulled from the closed jaws. When the distance between the upper and lower jaws is increased, the size of the opening increases to allow the nipple, including its enlarged end, to freely pass through. The upper and lower jaws are controlled by an actuator equipped for remote operation, so that manual intervention is not required lock the bails to the elevator.

Further, a link spreading mechanism, consisting of an actuator coupled between the upper portion of the pair of bails, is designed to spread the two bails apart so that they may freely accept an elevator without manual handling by riggers. The link spreading actuator then contracts to bring the bails together with the lower bail eyes receiving the bail posts.

Furthermore, one or more elevator ears may contain one or more internal conduits for communication of power and control signals between the suspended elevator and the bails. The passages exit the elevator ear at ports located in the distal face of the ear, which is designed to mate with a multi-coupling system connector assembly. The corresponding bail locking assembly is equipped with the multi-coupling system connector assembly which mates with the conduits by a remotely controlled actuator. Elevator control and power circuits are routed through the internal conduits of an elevator ear for automated coupling to the multi-coupling system connector assembly, which is connected to the power and control source for the elevator through one or more conduits strapped alongside the bail.

Thus, the whole process of coupling and uncoupling the elevator, including spreading and drawing in the bails, locking and unlocking the bail eyes to and from the elevator bail posts, and coupling and uncoupling power and control lines to the elevator, is preferably controlled remotely and can be automated. The method preferably uses hydraulic actuators for the link spreading device, the bail locking assemblies, and the optional bail post connector assemblies.

BRIEF DESCRIPTION OF THE DRAWINGS

The invention is described in detail hereinafter on the basis of the embodiments represented schematically in the accompanying figures, in which.

DESCRIPTION OF THE PREFERRED EMBODIMENT OF THE INVENTION

Figure 1:
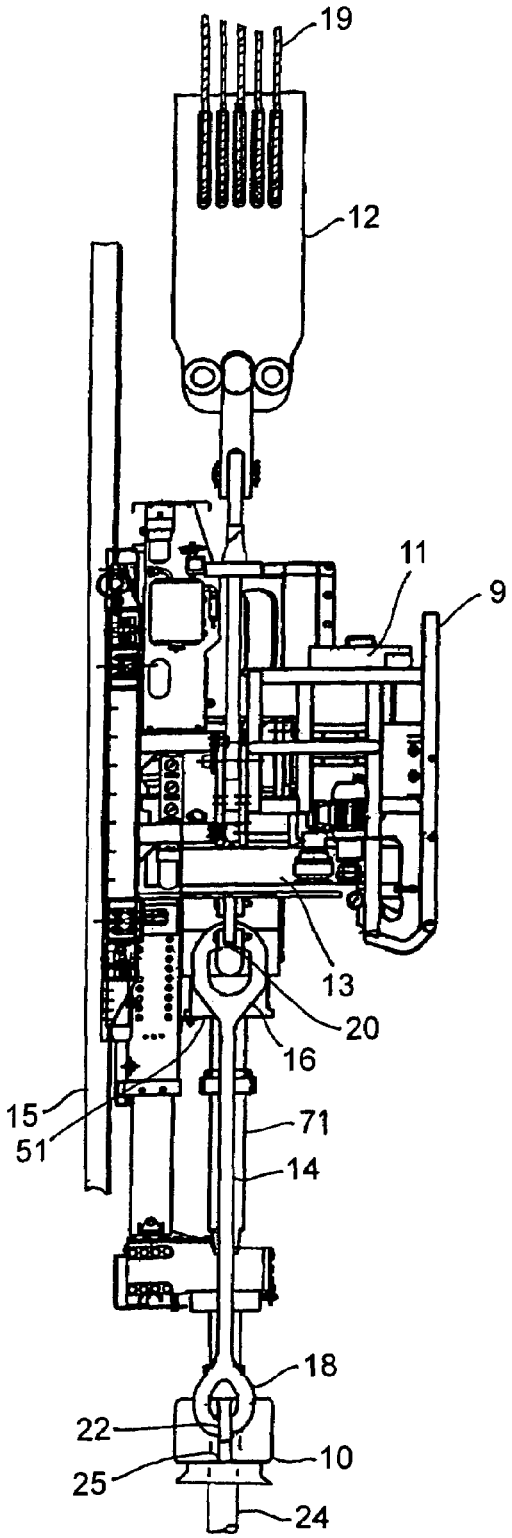
FIG. 1 (PRIOR ART)
FIG. 1 is a side view of a prior art arrangement for lowering or raising a tubular including an elevator which holds the tubular, bails suspending the elevator by its protruding ears from a top drive mechanism, and a traveling block which carries the entire arrangement.
Figure 2:
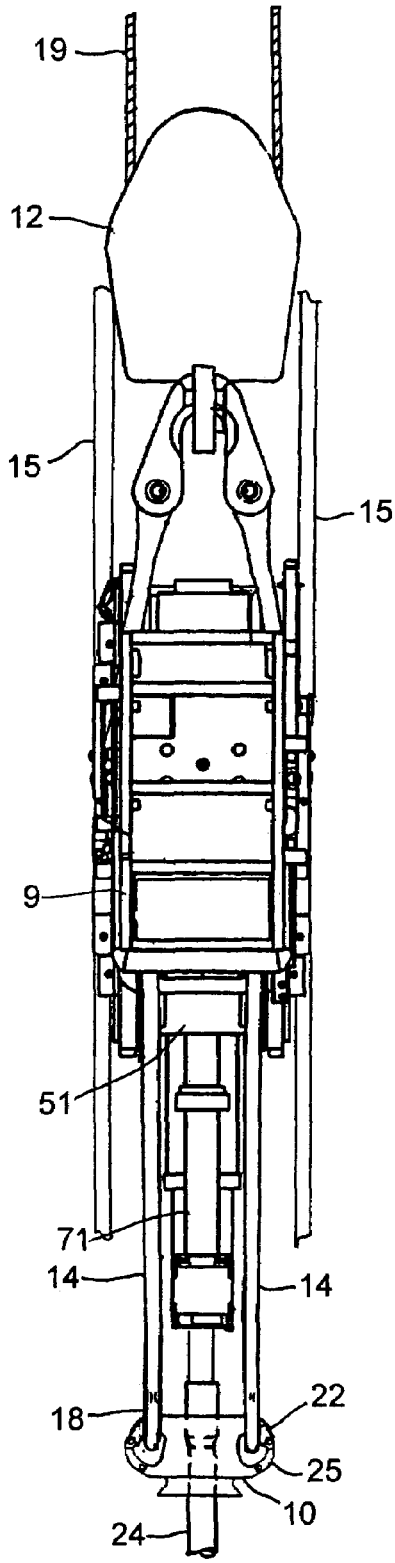
FIG. 2 (PRIOR ART)
FIG. 2 is a front view of the prior art arrangement of FIG. 1, showing the manually operated locking tabs of the elevator ears.
Figure 3:
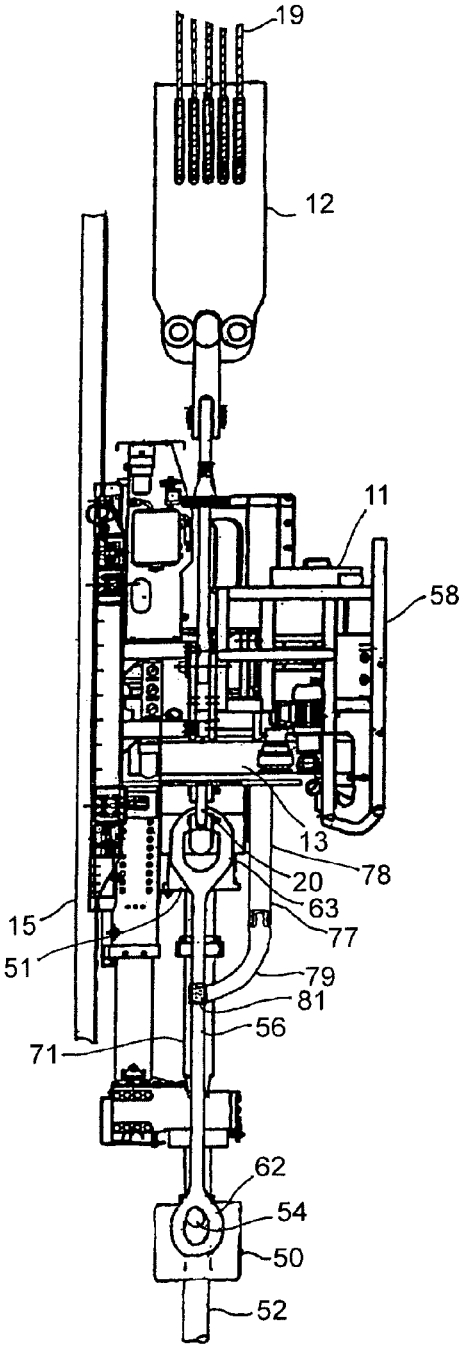
FIG. 3 is a side view of an arrangement according to one embodiment of the invention showing a link spreader assembly attached to a lower portion of a to drive assembly which attaches to the bails carrying the elevator using curved control arms.
Figure 4:
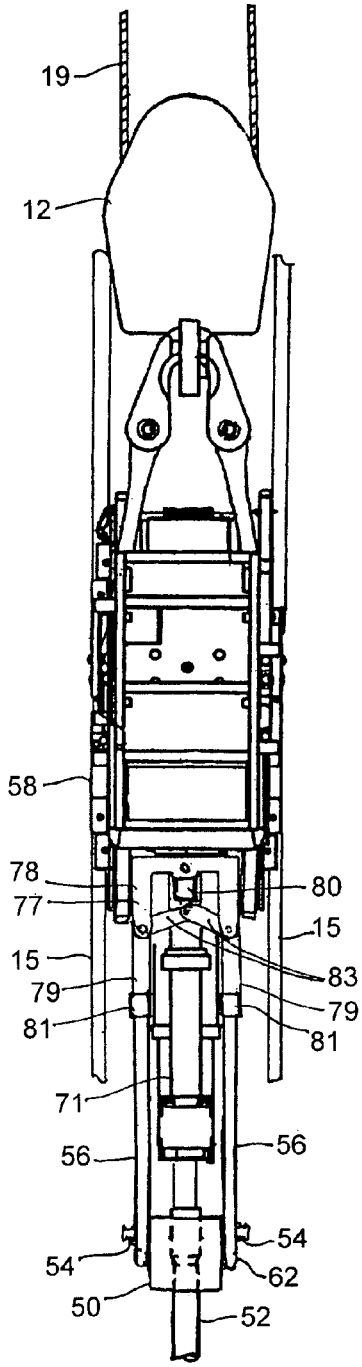
FIG. 4 is a front view of the arrangement of FIG. 3 showing the control arms of the link spreader mechanism in the contracted position wherein the bails are positioned with the lower eyes receiving the elevator ears.
Figure 5:
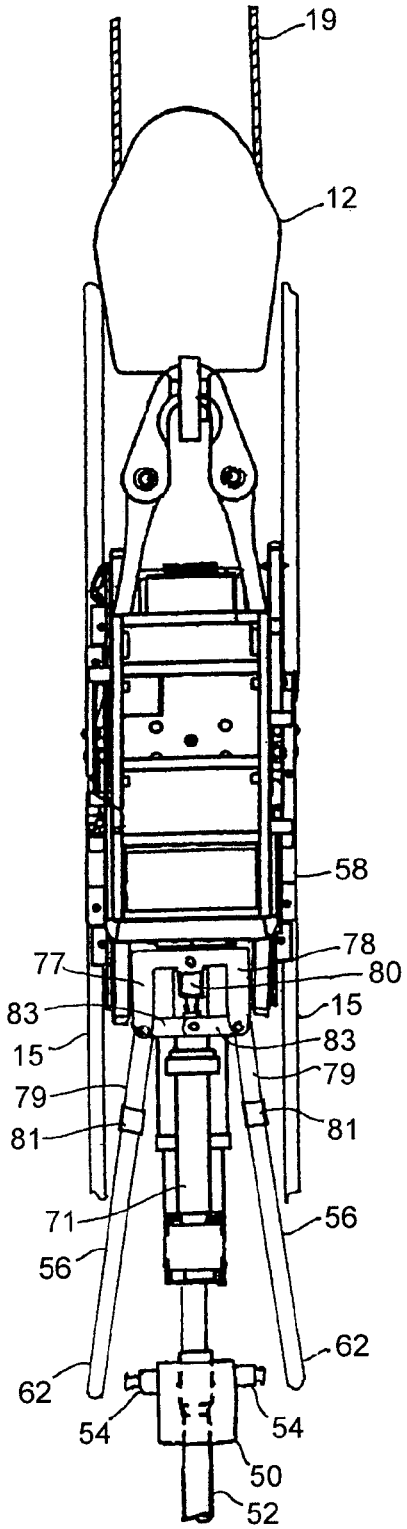
FIG. 5 is a front view of the arrangement of FIG. 3 showing the control arms of the link spreader mechanism in the extended position wherein the bails are positioned well outside of the elevator ears.

FIGS. 3-5 illustrate a top drive mechanism 58 according to one embodiment of the invention equipped with a link spreader mechanism 78 for hands-free movement of the suspended links 56. Top drive 58 is similar to the prior art top drive 9 of FIGS. 1-2, preferably having a motor 11, gear train 13, link supports 20, and sliding frame members 15. Additionally, the top drive 58 may include an air cooling system (not shown), a rotary hose connection (not shown), a rotary manifold (51), and a lower well control valve (71). As these top drive features are well known in the art, they are not discussed further herein. The link spreader mechanism 78 is ideally disposed at the lower portion of the top drive 58 near the link supports 20. The link spreader mechanism 78 preferably includes an inverted generally U-shaped frame 77 with each distal end of frame 77 acting as a fulcrum for a rigidly connected curved control arm 79/lever 83 pair. The distal end of each curved control arm 79 is coupled to a longitudinal portion of one of the links 56 by a collar 81. The distal end of each lever 83 is pivotably coupled to a hydraulic actuator 80 located in the center of the U-shaped frame 77. The hydraulic actuator 80 moves the two levers 83, which in turn move the control arms 79 and the links 56. FIGS. 3-4 illustrate the top drive 58 with the link spreader mechanism 78 in the contracted position, wherein the lower eyes 62 of links 56 are engaged about the ears 54 of elevator 50, and FIG. 5 illustrates top drive 58 with the link spreader mechanism 78 in an expanded position, wherein the lower eyes 62 of links 56 are spread apart away from the elevator ears 54. Although the link spreader mechanism 78 is shown as part of a top drive mechanism 58, the link spreader mechanism may be attached directly to the traveling block 12 if a top drive mechanism is not used. Other suitable mechanical arrangements and actuators may be used for the link spreader mechanism 78 in place of the embodiment shown in FIGS. 3-5.

Figure 6:
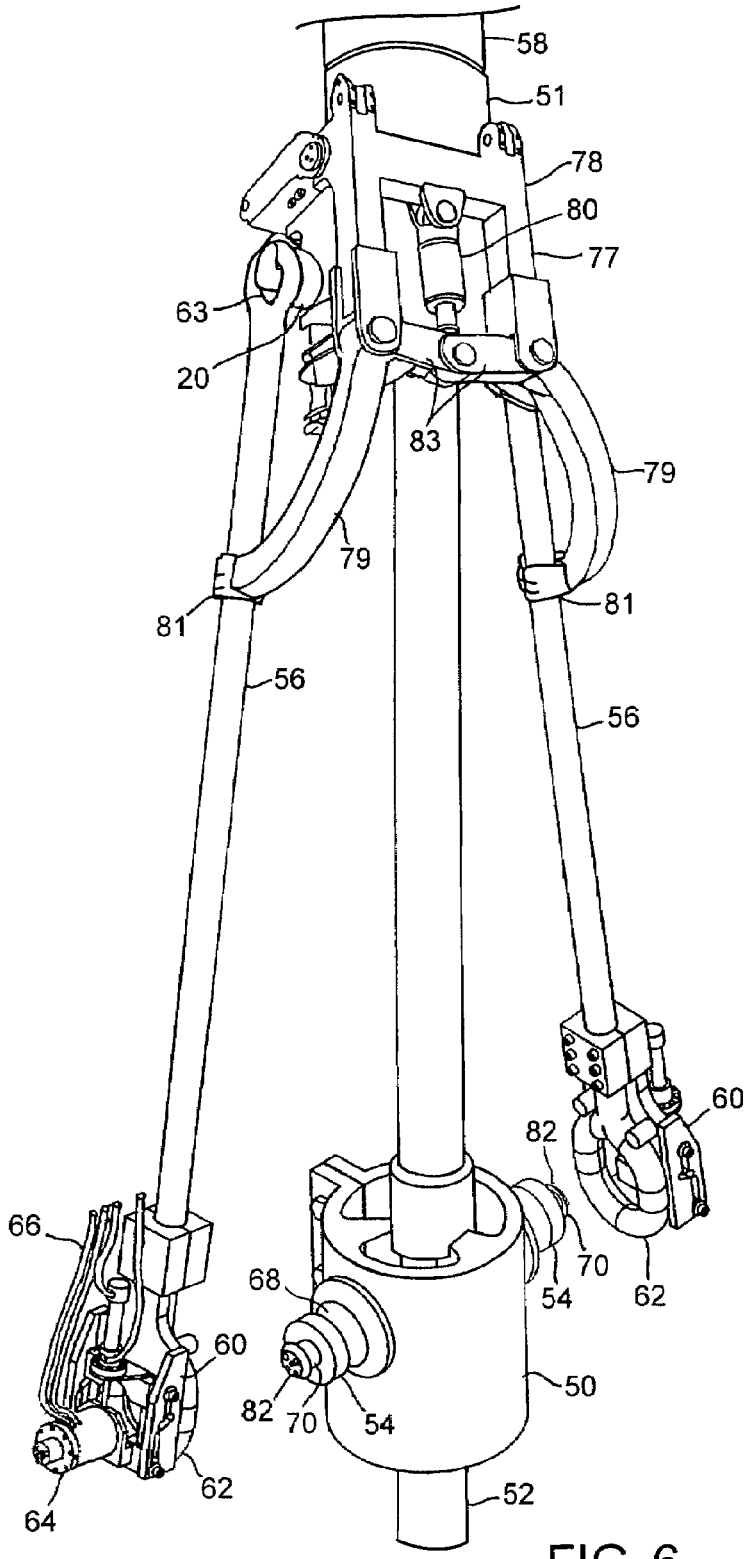
FIG. 6 is a perspective illustration of an arrangement according to one embodiment of the invention for lowering or raising a tubular including an elevator which holds the tubular, bails or links for suspending the elevator by its protruding bail posts from a top drive mechanism, a link spreader assembly attached to the top drive mechanism, and bail locking assemblies attached to the lower eyes of the bails to automatically secure the bail eyes to the elevator ears.

Referring to FIG. 6, a preferred embodiment of the invention is shown and includes an elevator 50 for holding a tubular 52, at least two structural post-style elevator ears 54, one bail 56 for each elevator ear 54 for suspending the elevator 50 from link supports 20 on top drive 58, a bail locking assembly 60 attached to the outer side of the lower eye 62 of each bail 56, and one or more optional multi-coupling system (MCS) connector assemblies 64 for communication of power and control signals with the suspended elevator 50. Elevators are well known in the art, and the specific construction of the elevator is not discussed further, except to specify that the elevator has post-style elevator ears 54 as described herein and may utilize a slip assembly, a bushing for seating a box connector profile, or other means to hold a tubular 52. The elevator ears 54 are preferably cast steel, integral with the elevator frame, and sized to withstand the expected loads with adequate safety margin. The elevator 50 may have electric, pneumatic, or preferably hydraulic systems therein. Control and power circuits are preferably routed through the center portion of one or more elevator ears 54 for quick coupling to a MCS connector assembly 64, which is in turn connected to the power and control source(s) for the elevator 50 through one or more conduits 66 strapped along side the bail(s) 56. Bails are also well known in the art, and for that reason the construction of the bails 56 is not discussed further. The lower eyes 62 of the bails 56 receive the elevator ears 54 and cradle them along concave surfaces 68 on ears 54. Each elevator ear 54 contains a nipple 70 for being received into and locked within the bail locking assembly 60 which is attached to the outer side of the lower eye 62. The nipple 70 has a radially extending protuberance at the distal end 82 which prevents the nipple 70 pulling axially out of the locked bail locking assembly 60.

Also shown in FIG. 6 is the link spreading mechanism 78 incorporated in top drive 58, as described above with reference to FIGS. 3-5. The link spreading mechanism 78 consists of an inverted generally U-shaped frame 77, an actuator 80, and two levers 83, each lever 83 rigidly fixed to a curved control arm 79. The two distal ends of the U-shaped frame 77 each act as a fulcrum about which the rigid lever/control arm combination pivots. The distal ends of the levers 83 are moved by actuator 80, causing a concomitant movement of the distal ends of the curved control arms 79. Because the distal ends of the control arms 79 are coupled to the links 56 by collars 81, when the actuator 80 is moved, the links 56 are moved. The link spreading actuator 80 is preferably a hydraulic piston/cylinder arrangement. The link spreader mechanism is designed and arranged to extend the two control arms 79 and attached bails 56 apart so that the lower bail eyes 62 may be placed around an elevator 50 without manual handling by riggers. The link spreading actuator 80 then draws the bails 56 together when the lower bail eyes 62 are positioned to receive the elevator ears 54. Top drive 58 has link supports 20 which serve as pivot points for the bails 56. Because the linear travel of the actuator 80 near the traveling block 58 is mechanically amplified at the lower ends of the bails 56, the actuator 80 need not have the capability to extend far in order to sufficiently spread the lower eyes 62 of the bails. While the link spreading mechanism 78 has been shown using a linear actuator 80 and a particular arrangement of linkages and control arms, it is within the scope of the invention to employ other suitable means for spreading the bails 56. Although the link spreading mechanism 78 helps to keep the links 56 from inadvertently separating from an attached elevator 50, the bail locking mechanisms 60 cooperate with the link spreading mechanism 78 to provide a much higher level of safety.

Figure 7:
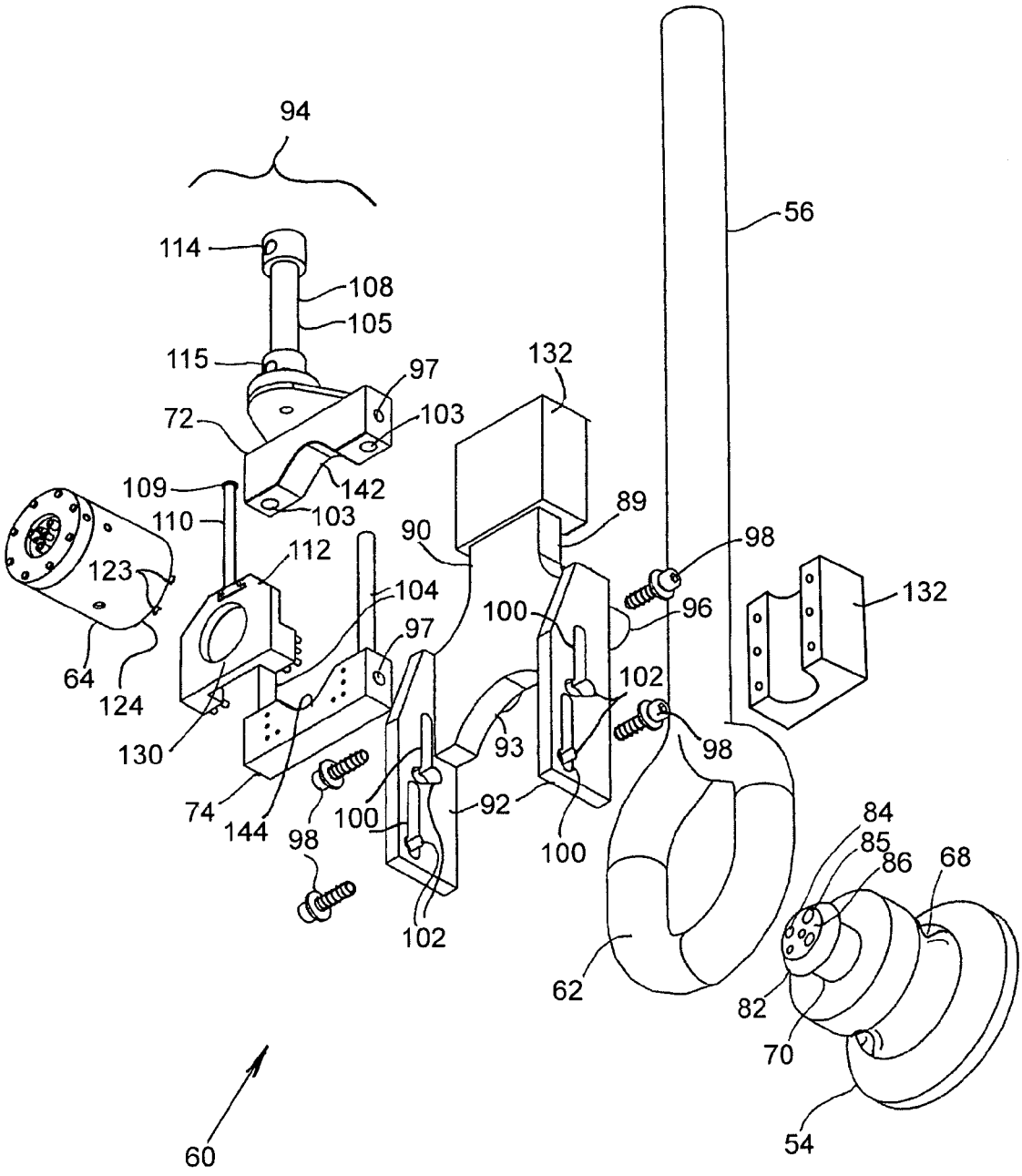
FIG. 7 is an explosion diagram viewed from an under and outside perspective showing a lower bail eye, a bail locking assembly for attachment thereto, an optional multi-coupling system connector assembly, and an elevator ear according to a preferred embodiment of the invention.
Figure 8:
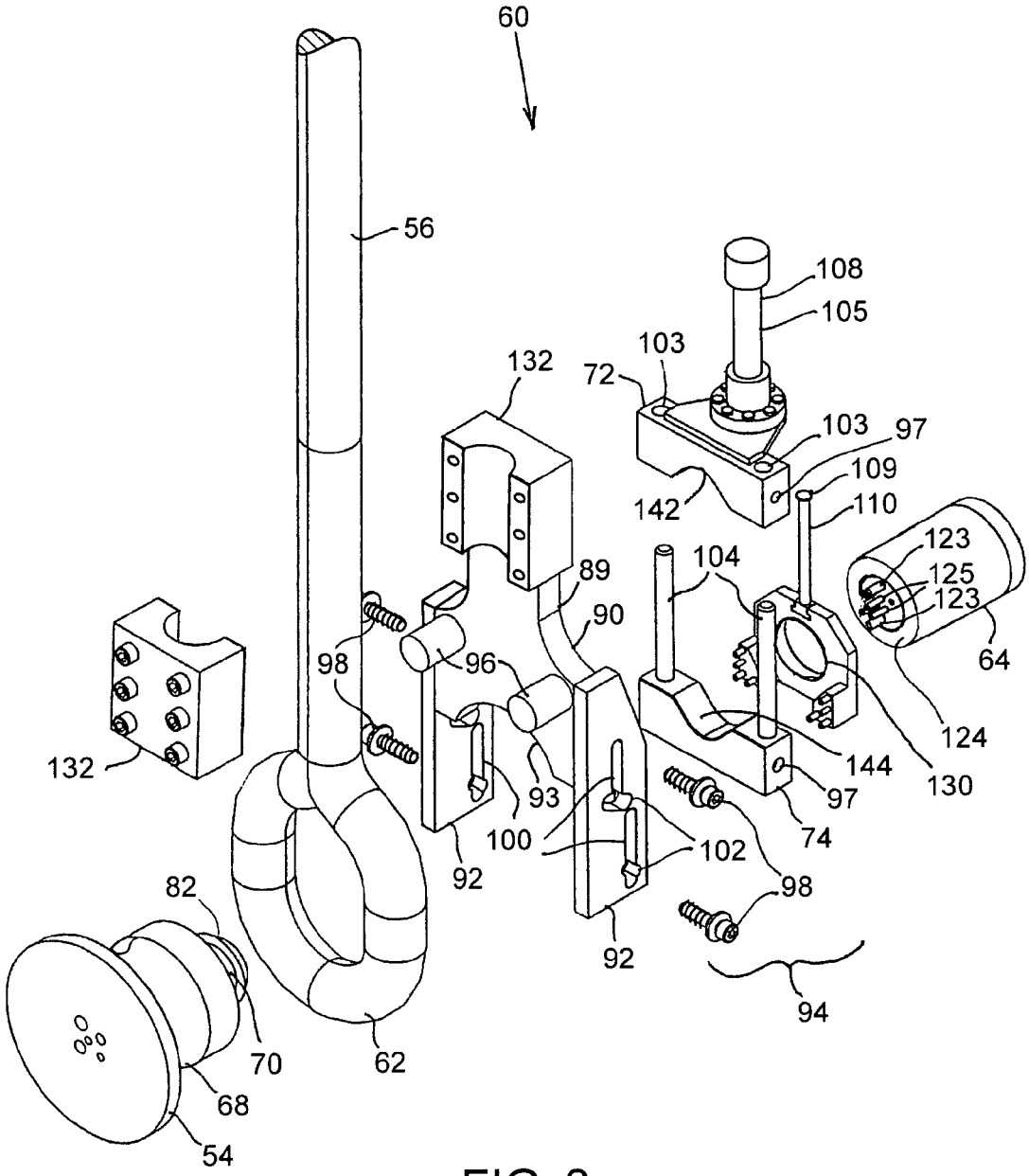
FIG. 8 is an explosion diagram of the assembly of FIG. 7 viewed from an above and inside perspective.

FIGS. 7 and 8 are explosion diagrams which illustrate a lower bail eye 62 (equipped with a bail locking apparatus 60) and a corresponding elevator ear 54 according to one embodiment. The locking assembly 60 contains an upper jaw 72 and a lower jaw 74. The lower jaw 74 preferably has two guide posts 104 fixed thereto, and the upper jaw 72 has an equal number of guide apertures 103 formed therethrough. Guide apertures 103 are positioned and sized to slidingly receive guide posts 104 so that upper and lower jaws 72, 74 have a fixed position relative to one another in all but one axis of movement. The upper and lower jaws 72, 74 each have concave clamping surfaces 142, 144 which form a generally circular aperture when the upper and lower jaws abut together.

Referring to FIGS. 7-8, the elevator ears 54 are generally cylindrical in shape with a concave surface 68 for mating with the interior surface of lower eye 62 of the bail 56. The system is designed for the lower bail eye 62 to cradle the elevator ear 54 along surface 68, which allows the ear 54 to pivot and rotate with respect to the bail 56. A nipple portion 70 of elevator ear 54 extends past the concave surface 68 for being received between the concave clamping surfaces 142, 144 of the upper and lower jaws 72, 74 of the bail locking apparatus 60. The nipple 70 is sized so that it just fits within the aperture formed by the closed jaws 72, 74 of the bail locking mechanism 60. In other words, the upper and lower jaws are designed to join together to clamp tightly around the nipple 70. The tip 82 of the nipple 70 has a larger diameter than the body of the nipple 70. The larger tip 82 is sized so that it may pass through the open jaws 72, 72 but not the closed jaws 72, 74 of the bail locking mechanism 60. Thus, when the upper and lower jaws 72, 74 of the bail locking assembly 60 are shut around the bail post nipple 70, the radially extending protuberance at the tip 82 of nipple 70 prevents the bail locking assembly 60, and thus lower bail eye 62, from being removed from the elevator ear 54.

As shown in FIGS. 7 and 8, one or more actuators 105 control the relative distance between the upper and lower jaws 72, 74. The preferred embodiment uses a hydraulic piston/cylinder arrangement 105, although other suitable actuators may be used. Cylinder 108 is attached to the top of upper jaw 72. A piston 109 is connected to a piston rod 110, which is in turn attached to lower jaw 74 via a bracket 112 mounted to the outer face of lower jaw 74. Upper and lower ports 114, 115 in cylinder 108 connect to a source of hydraulic fluid (not shown) to operate the piston 109 within cylinder 108. When fluid flows into the cylinder 108 through lower port 114, the piston 109 is forced upwards, displacing fluid from the cylinder through upper port 115 and causing the upper and lower jaws 72, 74 to clamp together. When the direction of the hydraulic fluid flow is reversed, the jaws open.

Referring to FIGS. 7 and 8, the bail locking assembly 60 includes a frame 89 having a back plate 90 and two side plates 92 mounted thereto. The frame 89 is supported on bail 56 by pins 96 which rest on the outer shoulders of lower eye 62. The frame 89 is secured to the bail 56 by clamping members 132. The black plate 90 generally does not extend to the lower edges of the side plates 92 so that the elevator ear 54 may pass freely between the side plates 92. Alternatively, back plate 90 may extend lower if it contains an aperture or slot 93 centered between side plates 92 to accommodate the elevator ear 54.

The upper and lower jaws 72, 74, which are slideably interconnected by guide posts 104 and guide apertures 103 and where clamping motion, i.e., the distance between the jaws, is controlled by piston/cylinder arrangement 105 and bracket 112, form a complete jaw subassembly 94 which is slideably housed in frame 89 between the two side plates 92. Bolts 98 fit through slots 100 in side plates 92 and screw into threaded holes 97 in the upper and lower jaws 72, 74. Thus, the jaw subassembly 94 is slideably captured by bolts 98 in slots 100 of side plates 92. If the elevator ear 54 is positioned clear of the bail locking assembly 60, the jaw subassembly 94 can freely slide up and down between side plates 92 with bolts 98 confined by slots 100. The distance between the upper and lower jaws 72, 74 is controlled solely by piston/cylinder arrangement 105 and is not a function of the frame 89. Obviously, the amount of travel of jaw subassembly 94 allowed by slots 100 is greater when the upper and lower jaws 72, 74 are abutted together in the locked position than when they are separated in the open position, because in the abutted position, the bolts 98 in the upper jaw 72 and the bolts 98 in the lower jaw 74 are spaced closer together than when the upper and lower jaws 72, 74 are separated, which allows the abutted jaw subassembly 94 to slide a further distance in slots 100 than the jaw subassembly 94 with jaws 72, 74 in the open separated position.

The upper and lower jaws 72, 74 must be positioned apart by piston/cylinder arrangement 105 in order to insert elevator ear 54 into the lower bail eye 62 and attached bail locking apparatus 60. When elevator ear 54 is inserted in lower eye 62 of bail 56 such that the concave surface 68 transversely aligns with the bail, the elevator ear nipple 70 transversely aligns between clamping surfaces 142, 144 of the upper and lower jaws 72, 74, and the nipple tip 82 (having the radial protuberance) transversely extends beyond the upper and lower jaws 72, 74. When piston/cylinder arrangement 105 is actuated in the closing direction by supplying hydraulic fluid to port 114, upper and lower jaws 72, 74 close around nipple 70 wherever it may be vertically positioned between the jaws.

For instance, assume elevator 50 is seated on the deck of a drilling platform. In order to suspend elevator 50, bails 56 are extended outwards of elevator ears 54 by link spreader mechanism 78 (FIG. 6). Ideally, when the bails 56 are drawn inward to receive the elevator ears 54, the bails 56 are positioned so that the elevator ears 54 are centered within the lower eyes 62. When the upper and lower jaws 72, 74 of the two bail locking assemblies 60 are drawn together by piston/cylinder arrangements 105, the jaws clamp around nipples 70 of the two elevator ears 54 with bolts 98 generally vertically centered in slots 100. Before the elevator 50 can be suspended, the play between the inner lower surfaces of the lower eyes 62 and the lower concave surfaces 68 of the elevator ears 54 must be removed. As traveling block 12/top drive 58 (FIGS. 3-6) is first raised, bails 56 and attached frames 89 of bail locking assemblies 60 move upward while jaw subassemblies 94 remain stationary, fixed around nipples 70 of elevator ears 54 until the ears 54 are supported by the lower inner surfaces of lower eyes 62. Once the play is removed, upper and lower jaws 72, 74 are no longer vertically centered in slots 100. Rather, when the elevator 50 is fully carried by bails 56 and the jaw subassemblies 94 are closed around nipples 70, the bolts 98 are positioned near the lower portions of slots 100. At these lower bolt positions, angled cross-slots 102 are formed in the side plates 92. Cross slots 102 allow the suspended elevator 50, with elevator ears 54, nipples 70, and jaw subassemblies 94 clamped thereto, to pivot with respect to bails 56, attached frames 89, and side plates 92, as described more fully below with reference to FIGS. 13-14.

One or more optional hydraulic, pneumatic or electric passages may pass through one or more elevator ears 54 for powering and controlling the elevator 50. The passages exit the elevator ear 54 at quick connectors 84 located in the distal face 86 of the elevator ear 54. The quick connectors 84 and the distal face 86 are designed to mate with the inner side 124 of an optional MCS connector assembly 64. Bracket 112 must have an opening 130 formed therein if use of the optional MCS connector assembly 64 is desired. The MCS connector assembly 64 mounts to bracket 112. The inner face 124 of the MCS connector assembly 64 has complementary quick connectors 125 which mate with the quick connectors 84 located in the distal face 86 of nipple 70. The MCS connector assembly preferably has one or more guide pins 123, and the distal face 86 of nipple 70 has complementary guide sockets 85 for receiving the guide pins 123 to ensure proper alignment and mating of the quick connector pairs 84, 125 and to protect the quick connector pairs from shear forces and side loads.

Figure 9:
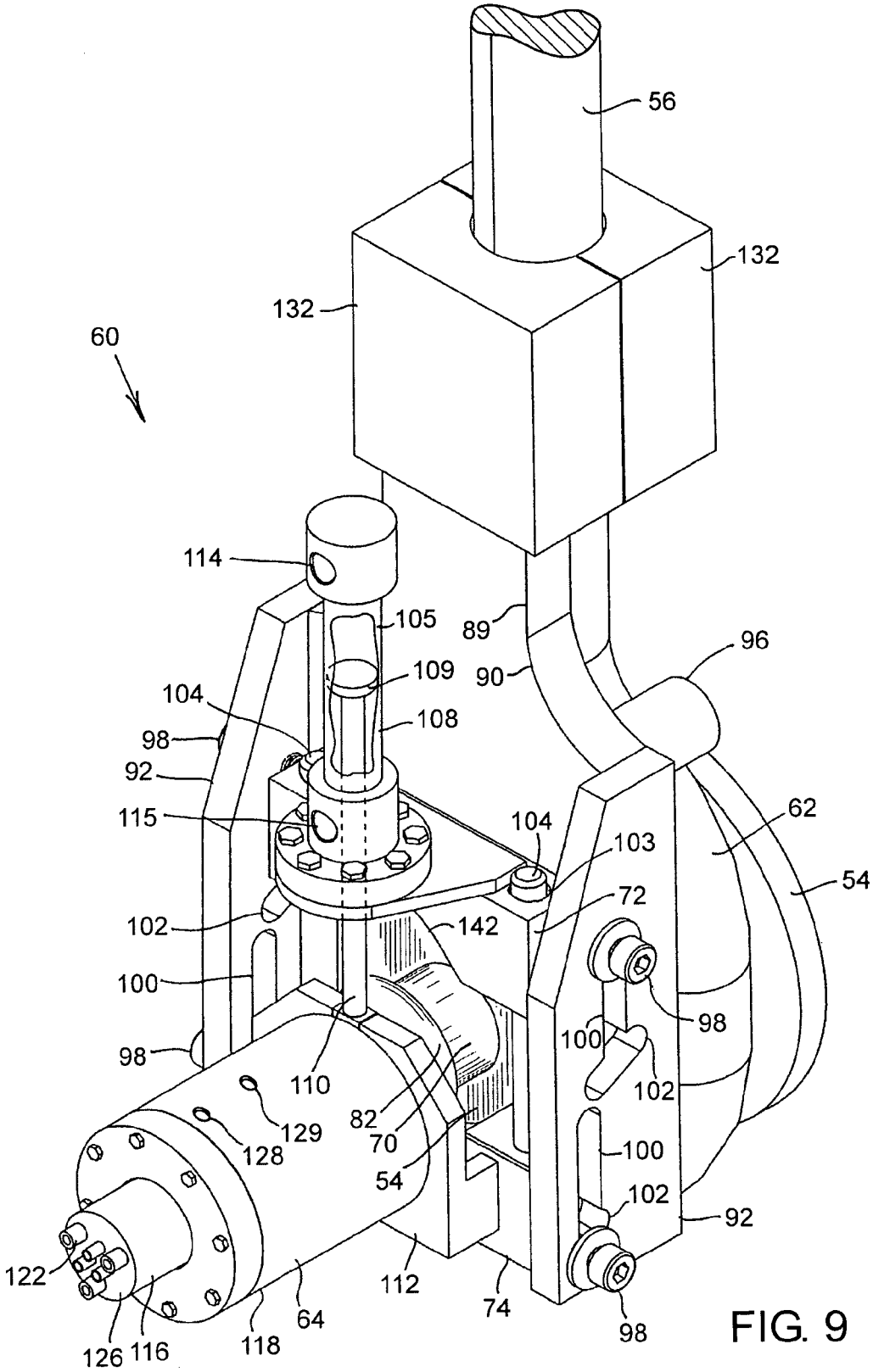
FIG. 9 is a frontal (outer) perspective illustration of the bail locking assembly according to a preferred embodiment of the invention attached to the lower eye of a bail and receiving an elevator ear, the bail locking assembly being equipped with a multi-coupling system connector assembly.

FIG. 9 is a perspective view of the bail locking assembly 60 of FIGS. 7 and 8 attached to the lower eye of bail 56, with upper and lower jaws 72, 74 open and with elevator ear 54 and nipple 70 of elevator 50 (not shown) received therein. The bail locking assembly 60 includes the optional MCS connector assembly 64. The bail locking assembly 60 includes a frame 89 having a back plate 90 and two side plates 92. The frame 89 is supported on bail 56 by pins 96 which rest on the shoulders of lower eye 62. Upper jaw 72 and lower jaw 74 each move up and down between side plates 92. Preferably, the upper and lower jaws 72, 74 each have two bolts or pins 98 which extend through slots 100 in the side plates 92. Angular cross slots 102 allow the closed jaws 72, 74, when positioned around a nipple 70 of a suspended elevator 50, to collectively pivot in and out with respect to the frame 89. In other words, because when in use the frame 89 is rigidly attached to the bail 56 and the jaws are clamped around the bail post nipple 70, the angular cross slots 102 allow the bails 56 to pivot slightly with respect to the suspended elevator 50. Upper jaw 72 has two vertical holes 103 which pass completely through it for sliding on guide posts 104 which are fixed to lower jaw 74. Thus, regardless of how the jaws 72, 74 collectively pivot with respect to frame 89, upper jaw 72 and lower jaw 74 are always in alignment with each other.

Once jaws 72, 74 are clamped around nipple 70, MCS connector assembly 64, if installed, mates with elevator ear face 86, using guide sockets 85 and quick connectors 84 (FIG. 7) to establish fluid and/or electrical connections with elevator 50. MCS connector assembly 64 preferably consists of an inner movable cylinder 116 coaxially disposed within an outer fixed cylinder 118 and which can be moved axially with respect to the outer cylinder 118 toward or away from elevator ear 54. Inner cylinder 116 contains one or more longitudinal passages 122 which are individually connected to the complementary quick connectors 123 located at the inner end 124 of the MCS connector assembly (FIG. 8). At the outer end 126 of inner cylinder 116, passages 122 connect to flexible conduits (not shown) which are preferably routed along side the bails 56 to connect to elevator power and control sources.

Figure 10:
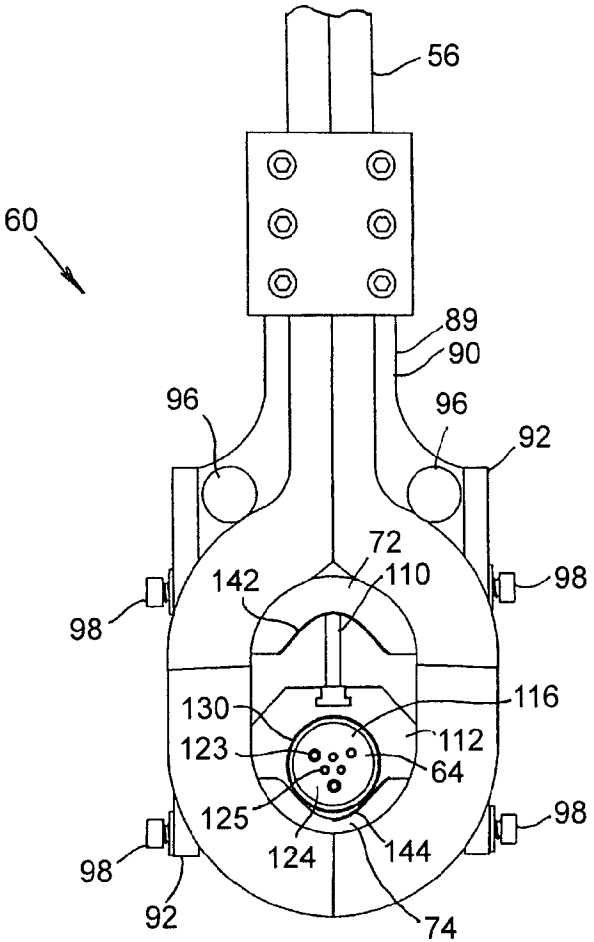
FIG. 10 is a rear (inner) view of the locking assembly of FIG. 9 shown with upper and lower jaws in the open position and with a multi-coupling system connector assembly for receiving an elevator ear.

FIG. 10 illustrates a lower bail eye 62 with attached bail locking assembly 60 according to one embodiment as viewed from the elevator side. Upper and lower jaws 72, 74 are open to receive the nipple 70 of an elevator ear 54 (FIG. 7), and the optional MCS connector assembly 64 is attached to the outside of bracket 112. Aperture 130 in bracket 112 reveals the MCS quick connectors 125 and guide pins 123 for mating with elevator ear 54 (FIG. 7). The bail locking assembly 60 is attached to bail 56 by a clamp assembly 132 which is secured about the bail just above the lower eye 62. Pins 96 help to vertically support the locking assembly 60 on the lower eye 62. The upper jaw 72 and the lower jaw 74 have complementary concave profiles 142, 144 to form clamping surfaces which when closed fits around nipple 70 (FIGS. 7-8) but will not allow bail post tip 82 (FIG. 7) to pull through the clamped jaws.

Figure 12:
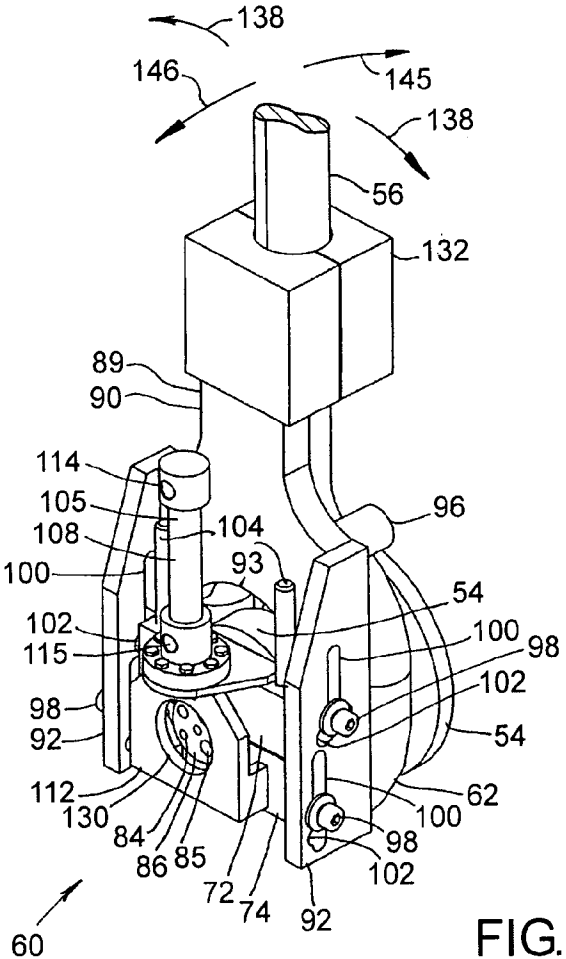
FIG. 12 is a front (outer) perspective illustration of the bail locking assembly of FIG. 11 shown with upper and lower jaws in the closed locked position around the elevator ear.
Figure 11:
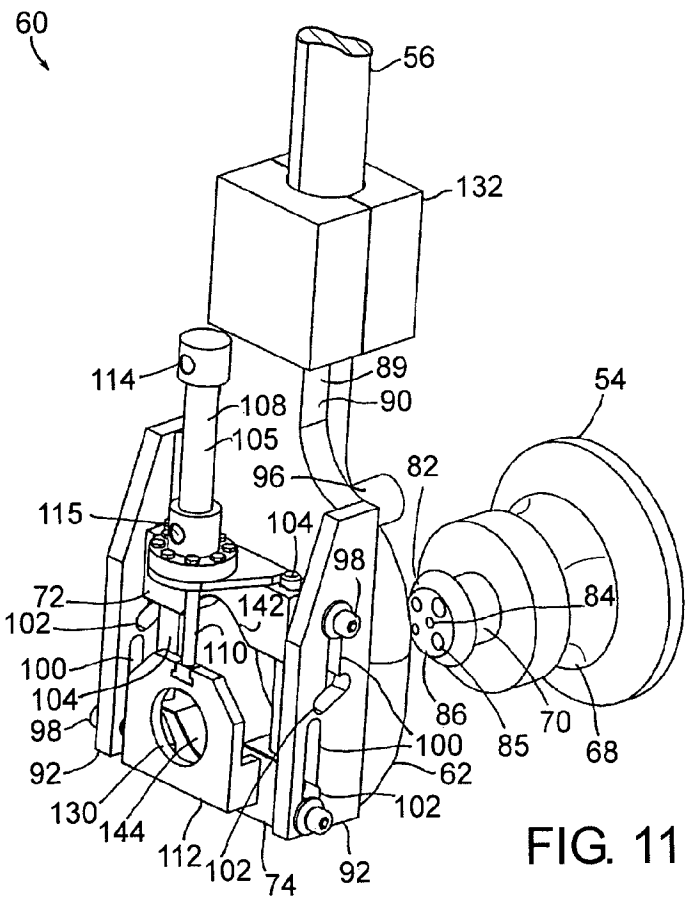
FIG. 11 is a front (outer) perspective illustration of the bail locking assembly of FIG. 9 shown with upper and lower jaws in the open unlocked position and ready to receive an elevator ear, the assembly being attached to the lower eye of the bail and not being equipped with a multi-coupling system connector assembly.

FIGS. 11 and 12 are perspective views of the bail locking apparatus 60 according to one embodiment without the optional MCS connector assembly 64 (FIGS. 7-8) installed. FIG. 11 shows the bail locking apparatus 60 with upper and lower jaws 72, 74 open, ready to receive elevator ear 54. FIG. 12 shows elevator ear 54 (FIG. 11) clamped between upper and lower jaws 72, 74, which prevents bail eye 62 from being removed from elevator ear 54. The upper jaw 72 slides on guide cylinders 104 which are fixed to lower jaw 74, and the spacing between the upper and lower jaws is controlled by actuator 105. The jaws 72, 74 are slideably connected to the frame 89 by bolts or pins 98 which extend from the jaws through slots 100 in side plates 92. Angular cross slots 102 allow the jaws 72, 74 to pivot in and out with respect to the frame 89 in directions 145, 146, respectively (i.e., radially with respect to tubular 52 when suspended in the locked position as shown in FIG. 6). The degree of freedom in the direction of arrows 145, 146 allowed by cross slots 102 is preferably +/−4 degrees of pivot. Also, because nipple 70 (FIG. 11) is cylindrical and the aperture formed by clamping surfaces 142, 144 of closed jaws 72, 74 is generally cylindrical, locking assembly 60 may coaxially rotate about elevator ear 54 as shown by arrows 138. At least fifty degrees of free coaxial rotation is preferable.

Figure 13:
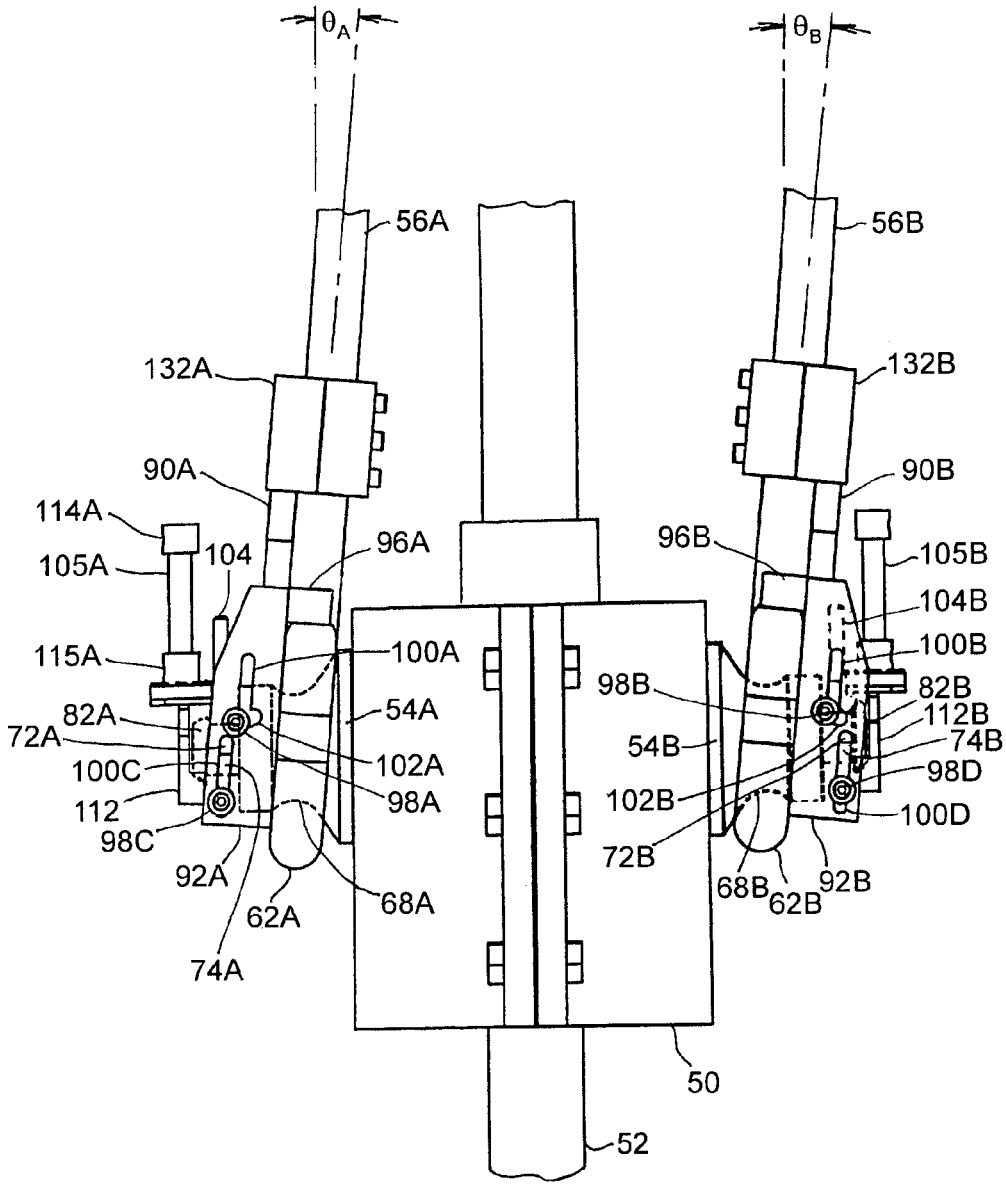
FIG. 13 is a front view of an elevator suspended by two bails according to one embodiment of the invention which shows side views of the bail locking assemblies clamped to the elevator ears, wherein the left hand bail is pivoted in toward the elevator and the right hand bail is pivoted out away from the elevator.

FIG. 13 illustrates how angular cross-slots 102 allow bails 56 to pivot in and out with respect to elevator 50. The left hand bail 56A is pivoted in toward elevator 50 by $\theta_A$ degrees from vertical. Upper bolt 98A, attached to upper jaw 72A which is clamped around elevator ear 54A, does not move when bail 56A is pivoted. As bail 56A is pivoted inward, bail locking apparatus frame back plate 90A and side plates 92A are likewise pivoted. Upper angular cross-slot 102A allows clearance for upper bolt 98A as the link is pivoted. Bolt 98A is positioned in the lower outer portion of cross-slot 102A, and the upper inner portion of cross-slot 102A is exposed. The same effect occurs for lower bolt 98C, but because it is closer to the lower inner surface of lower eye 62A, the pivot point for bail 56A, the travel in the lower cross slot is not as great. Bracket 112A, which is attached directly to the lower jaw 74A and indirectly to the upper jaw 72A via the piston/cylinder arrangement 105A, remains stationary with elevator ear 54A while bail 56A is pivoted inward. Thus, the optional MCS connector assembly 64 (not shown), which attaches to bracket 112, is held stationary to prevent side forces from acting on the quick connectors at the tip 82A of the elevator ear.

Similarly, on the right-hand side of FIG. 13, bail 56B is pivoted away from the elevator 50 by $\theta_B$ degrees from vertical. Upper bolt 98B, attached to upper jaw 72B which is clamped around elevator ear 54B, does not move when bail 56B is pivoted. As bail 56B is pivoted outward, bail locking apparatus frame back plate 90B and side plates 92B are likewise pivoted. Upper angular cross-slot 102B allows clearance for upper bolt 98B as the link is pivoted. Bolt 98B is positioned in the upper inner portion of cross-slot 102B, and the lower outer portion of cross-slot 102B is exposed. The same effect occurs for lower bolt 98D, but because it is closer to the lower inner surface of lower eye 62B, the pivot point for bail 56B, the travel in the lower cross slot is not as great. Like bracket 112A, bracket 112B is also held stationary as bail 56B pivots, allowing use of a MCS connector assembly 64 (not shown). Cross slots 102 are preferably designed to allow $\theta_A$ and $\theta_B$ to each reach four degrees.

Figure 14:
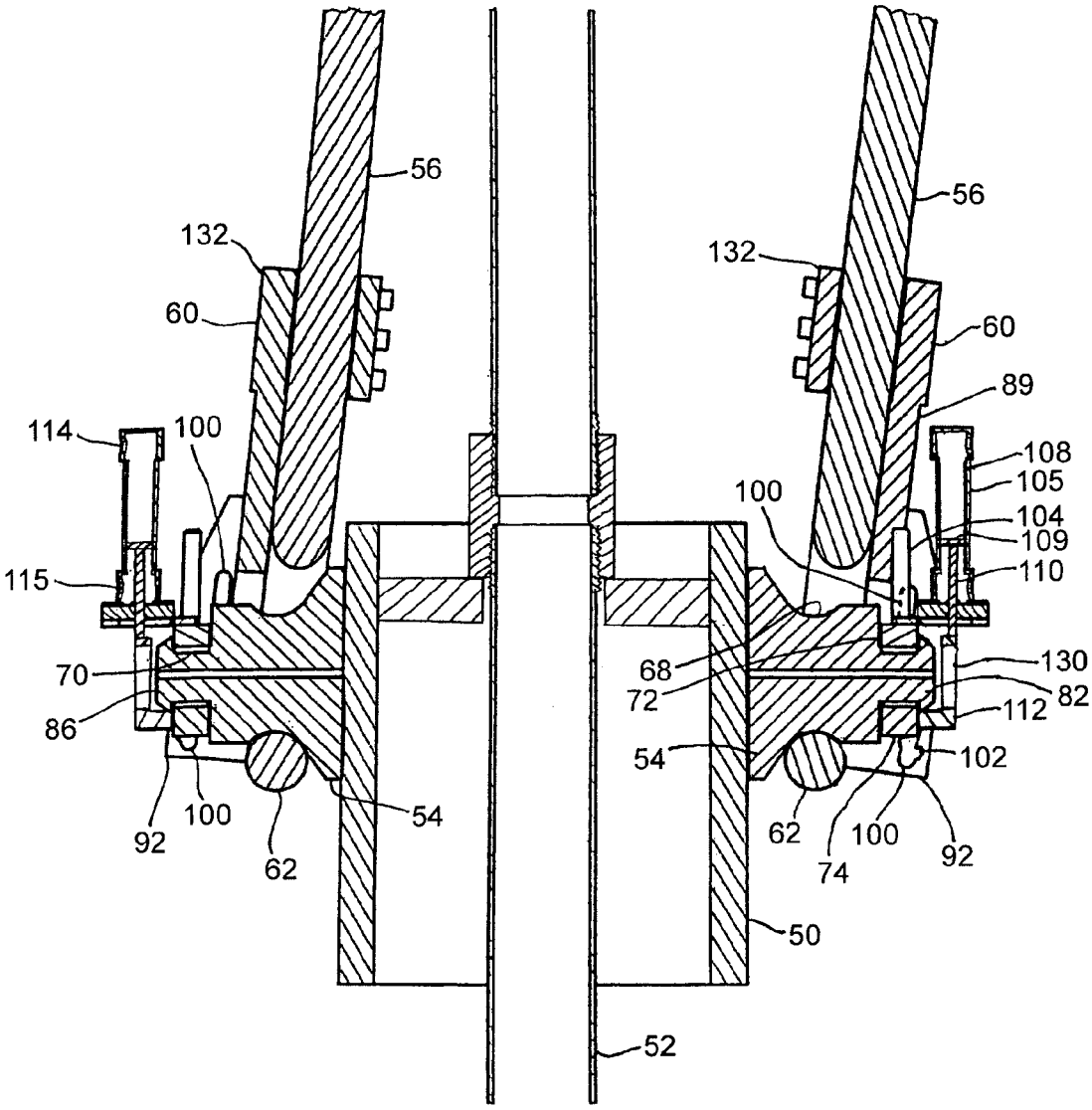
FIG. 14 is a cross section of FIG. 13 taken vertically through the center of the elevator passing through the center of the two elevator ears.

FIG. 14 is a detailed cross section of FIG. 13 which shows upper and lower jaws 72, 74 clamped around nipples 7. The jaws 72, 74 hold brackets 112 stationary while the bails 56 and frames 89 of the bail locking assemblies 60 are pivoted inward and outward.

Figure 15:
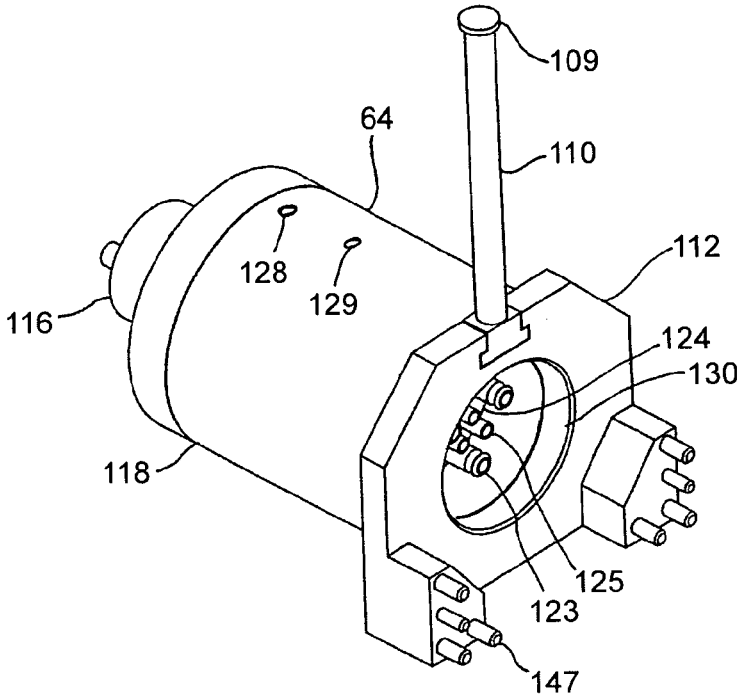
FIG. 15 is a perspective illustration of the multi-coupling system connector assembly according tone embodiment of the invention showing the inner end of the connector assembly which mates with an elevator ear.

FIG. 15 shows the inner end 124 of the MCS connector assembly 64 connected to bracket 112. Pins or bolts 147 are used to mount bracket 112 to lower jaw 74. One or more electric, pneumatic or hydraulic connectors 123 are designed to quick connect or otherwise mate with quick connectors 84 in nipple 70 (FIG. 7). Preferably, one or more guide pins 125 plug into guide receptacles 85 in nipple 70 (FIG. 7) to ensure proper mating of the MCS connector assembly to nipple 70. Ports 128, 129 provide for connection to hydraulic lines to engage or disengage the MCS connector assembly 64.

Figure 16:
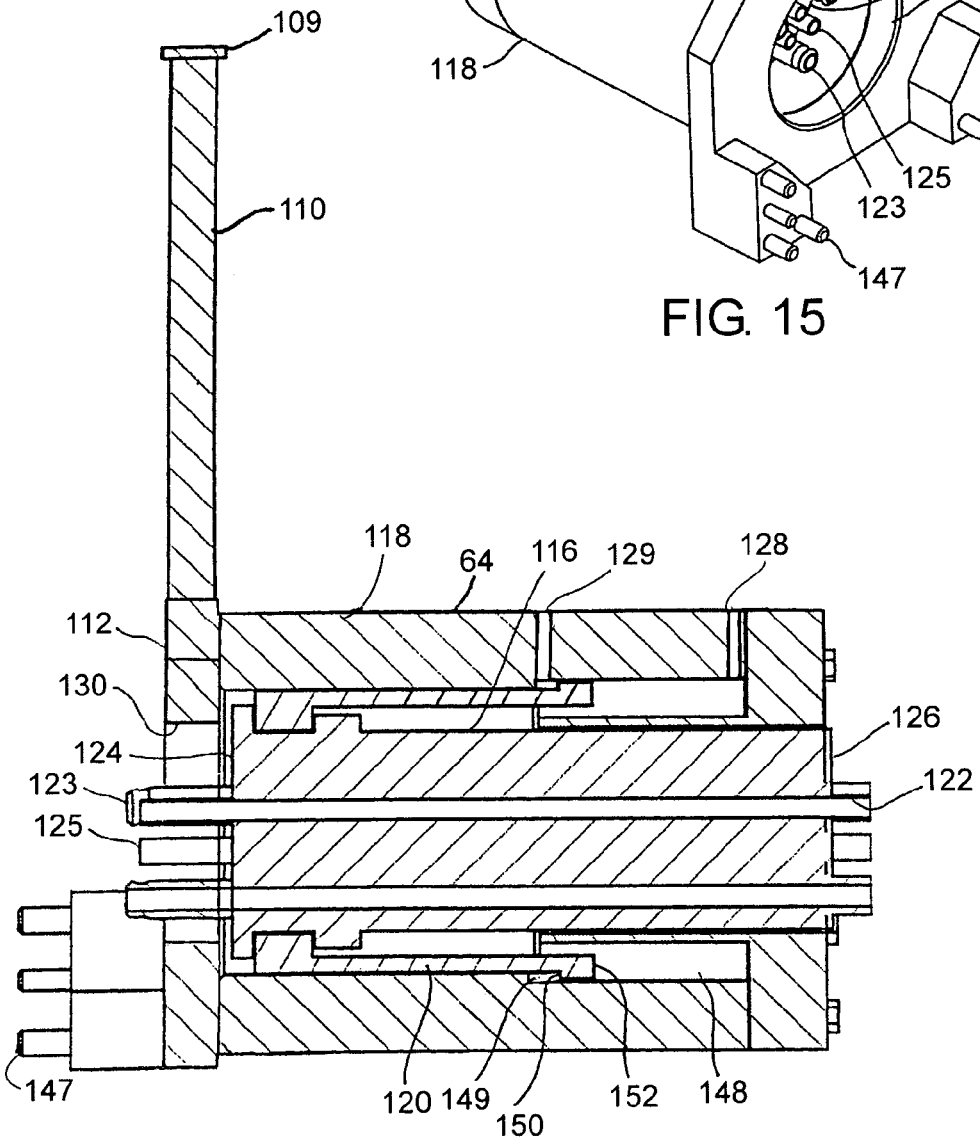
FIG. 16 is a vertical axial cross section of the multi-coupling system connector assembly of FIG. 15.

FIG. 16 shows a detailed cross-section of the MCS connector assembly 64. The quick connectors 123 on inner end face 124 of inner cylinder 116 are electrically or fluidly coupled to ports 122 on the outer face 126 of inner cylinder 116. Inner cylinder 116 is slideably moved axially within outer cylinder 118 by piston 120 which is in mechanical engagement with or integral to inner cylinder 116. The piston 120 and the inner cylinder 116 are dynamically sealed against the outer cylinder 118. The piston 120 has an inner face 150 and an outer face 152. To engage the bail post connector assembly 64, hydraulic fluid within the cavity 148 formed between outer cylinder 118 and outer piston face 152, is supplied via port 128 and acts on outer piston face 152 to axially move piston 120 and connected inner cylinder 116 towards elevator ear 54 (FIGS. 7-9), while the hydraulic fluid contained within the cavity 149 bounded by outer cylinder 118 and piston 120 is displaced by inner piston face 150 out of port 129. To disengage the MCS connector assembly 64, hydraulic fluid is supplied via port 129 to cavity 149 to act on inner piston face 150 and move piston 120 and connected inner cylinder 116 axially away from elevator ear 54 (FIGS. 7-9). The MCS connector assembly 64 preferably has no splines or other rotation limiting mechanism which prevents rotation of inner cylinder 116 within outer cylinder 118. Thus, bails 56 and bail locking assemblies 60 can rotate about elevator ears 54 without disturbing the MCS power and control quick connections 84, 125. While a particular hydraulic arrangement is described for the MCS connector assembly 64, alternate arrangements, including electric or pneumatic, are within the scope of the invention.

Figure 17:
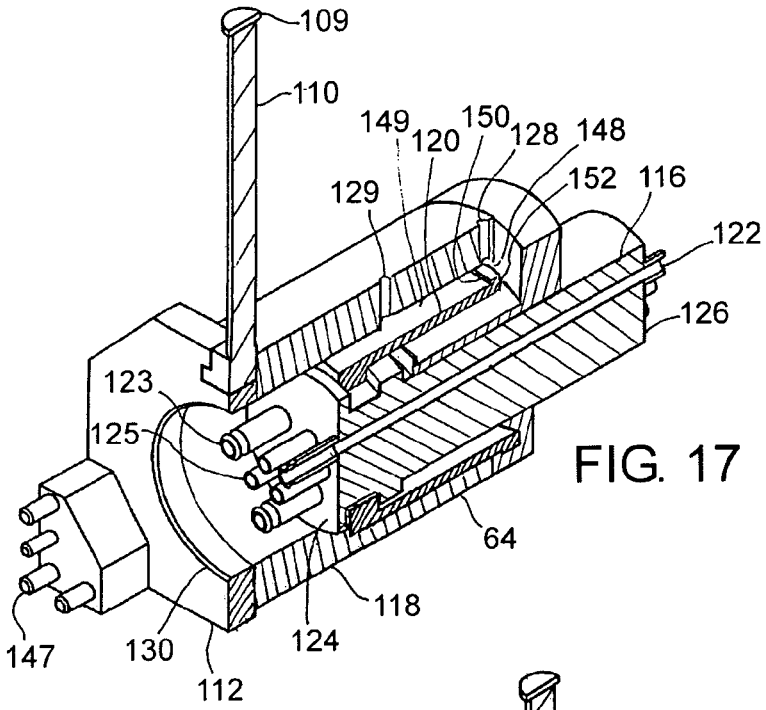
FIG. 17 is a perspective illustration in partial cross-section of the multi-coupling system connector assembly of FIGS. 15-16 showing the internal construction with the inner cylinder of the assembly in the disengaged axial position.
Figure 18:
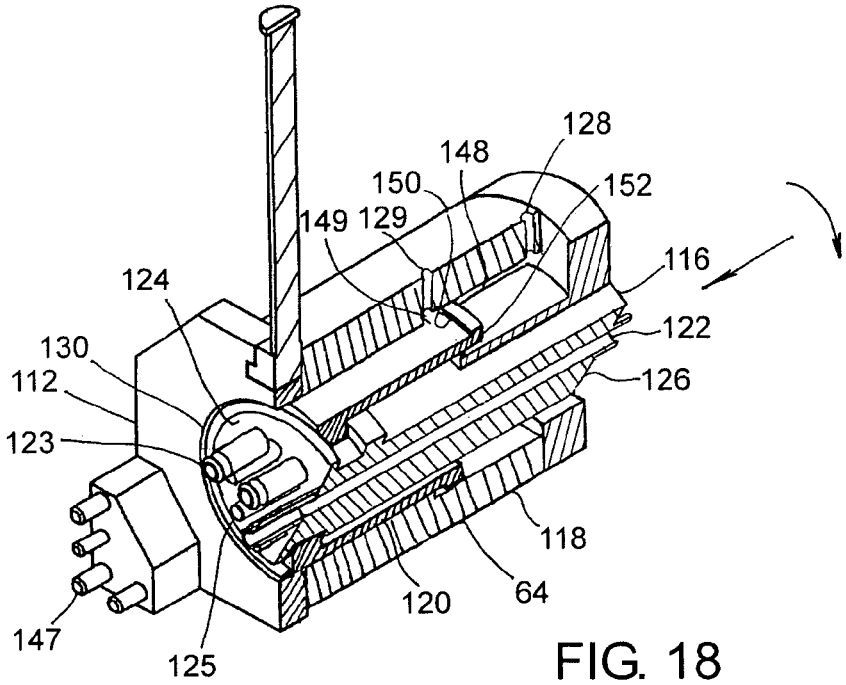
FIG. 18 is a perspective illustration in partial cross-section of the multi-coupling system connector assembly of FIGS. 15-17 showing the internal construction with the inner cylinder of the assembly in the engaged axial position and rotated compared to the inner cylinder of FIG. 17.

FIGS. 17 and 18 are perspective views in cross section of the MCS connector assembly 64. Outer cylinder 118 is mounted to bracket 112 and contains ports 128, 129 disposed on either side of movable piston assembly 120 for directing hydraulic fluid to the operating surfaces 150, 152 of the piston assembly 120. Piston assembly 120 is mechanically engaged with inner cylinder 116. Both the piston assembly 120 and the inner cylinder 116 are dynamically sealed against outer cylinder 118. The piston 120 axially moves inner cylinder 116 to engage or disengage the MCS quick connectors 123 with nipple 70 (FIGS. 7-8). In FIG. 17, inner cylinder 116 is in the disengaged position, and in FIG. 18, inner cylinder 116 is axially moved into the engaged position. MCS connector assembly 64 is preferably designed so that inner cylinder 116 can rotate with outer cylinder 118, particularly when in an engaged position. This ability to rotate allows the bails 56 to rotate around the elevator ear (in the direction of arrows 138 of FIG. 12) while allowing the power and control connectors at elevator ear 54 to remain intact as described below with respect to FIG. 19. To illustrate the rotation, the inner cylinder 116 of FIG. 18 is rotated about ten degrees compared to the inner cylinder 116 of FIG. 17. Although the bail post connector assembly 64 is described as having a particular hydraulic arrangement, other arrangements, including pneumatic or electric actuators, may be also used and are within the scope of the invention.

Figure 19:
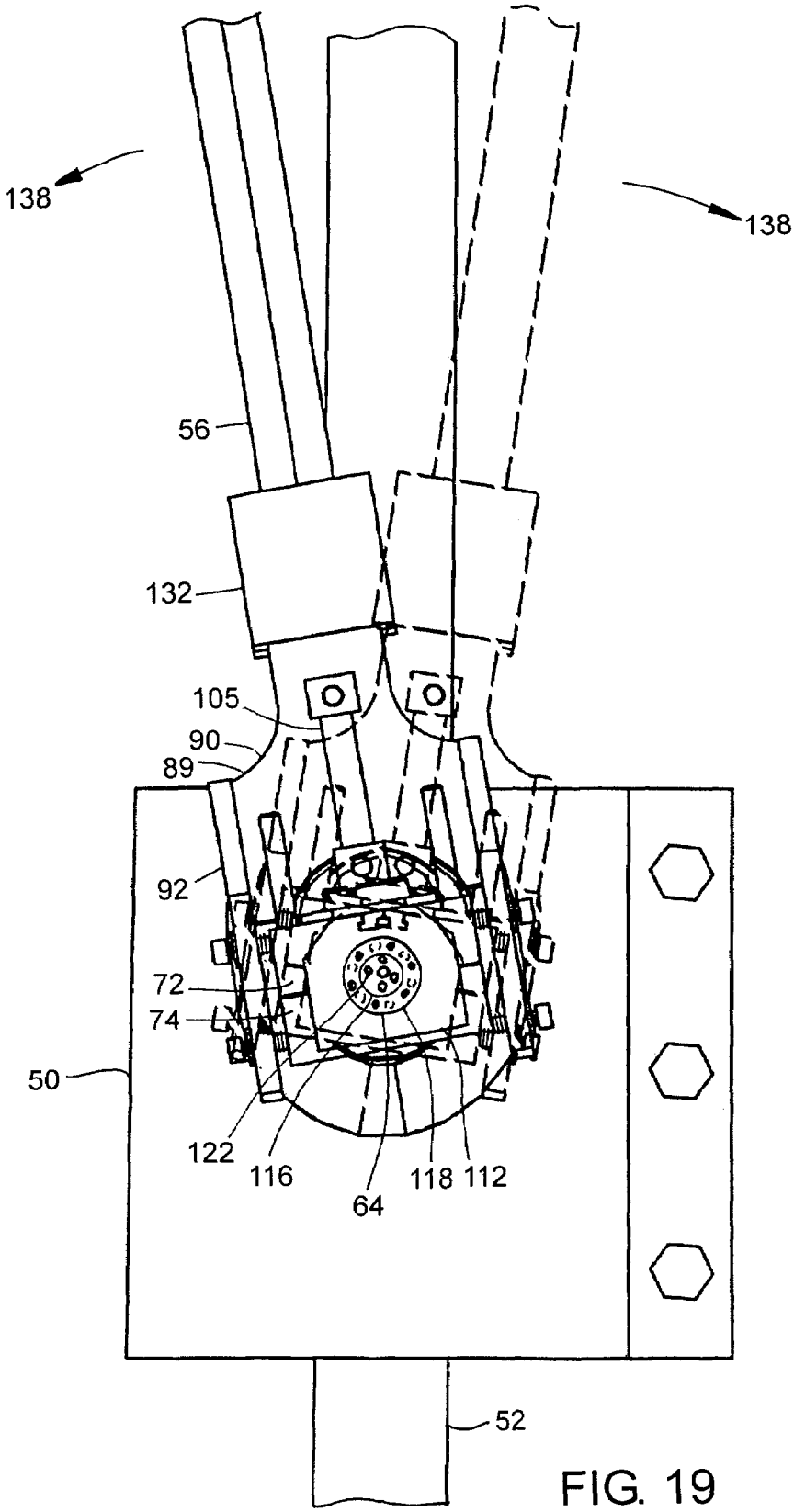
FIG. 19 is a side view of the elevator of FIG. 13 showing a front outer view of a bail and bail locking assembly with optional multi-coupling system connector assembly attached thereto showing the capability of the system to allow rotation of the bail about the elevator ear.

FIG. 19 illustrates how the MCS connector assembly 64 allows rotation of bail 56 about the elevator ear in the directions of arrows 138. As bail 56 is rotated about the elevator ear, the frame 89, back plate 90, side plates 92, upper and lower jaws 72, 74, bracket 112, and outer cylinder 118 of the MCS connector assembly 64 are all likewise rotated. However, inner cylinder 116 of the MCS connector assembly, which is coupled to the elevator ear 54 by quick connector pairs 125, 84, guide pins 123, and guide sockets 85, remains stationary. In other words, outer cylinder 118 rotates about inner cylinder 116 as shown in FIG. 19.

Figure 20:
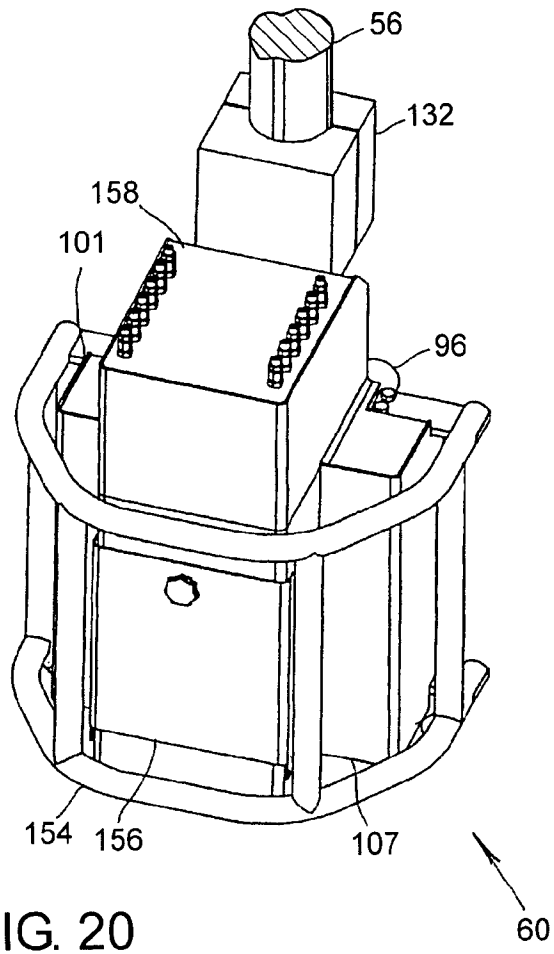
FIG. 20 is a perspective illustration of the bail locking assembly according to the invention showing a cover assembly which surrounds the bail locking assembly and bail post connector assembly.

FIG. 20 shows the locking assembly 60 according to the invention equipped with a protective cover assembly. The cover assembly preferably includes one or more individual covers 101, 158, and a protective tubular frame 154 which mount to bail locking assembly frame 89 (not visible). One or more quick access covers 156 are attached by hinges and latches to allow easy inspection and maintenance. The cover assembly can be used both for an individual bail locking assembly 60 or a bail locking assembly 60/bail post connector assembly 64 combination. The cover assembly protects both personnel from injury and the bail locking assembly 60 and MCS connector assembly 64 from damage.

The Abstract of the disclosure is written solely for providing the public at large with a means by which to determine quickly from a cursory inspection the nature and gist of the technical disclosure, and it represents solely a preferred embodiment and is not indicative of the nature of the invention as a whole.

While the preferred embodiment of the invention has been illustrated in detail, it is apparent that modifications and adaptations of the preferred embodiment will occur to those skilled in the art. Such modifications and adaptations are in the spirit and scope of the invention as set forth herein:

What is claimed is:

1. A method for moving a tubular (52) comprising the steps of, holding said tubular with an elevator (50) designed and arranged for holding said tubular and having first and second elevator ears (54) extending therefrom, coupling a first end (62) of a first bail (56) to said first elevator ear, coupling a first end (62) of a second bail (56) to said second elevator ear, remotely actuating a first bail locking apparatus (60) by which said first bail is locked to said first elevator ear, remotely actuating said elevator via at least one conduit (84) which passes through said first elevator ear (54), remotely actuating a second bail locking apparatus (60) by which said second bail is locked to said second elevator ear, and then simultaneously moving said first and second bails in a common direction.

2. The method of claim 1 further comprising the step of, allowing said first bail to pivot in a radial direction (145, 146) with respect to said tubular while said first bail is locked to said first elevator ear.

3. The method of claim 1 further comprising the step of revolving said first bail about said first elevator ear while said first bail is locked to said first elevator ear.

4. The method of claim 1 further comprising the steps of remotely actuating a spreading mechanism (78) coupled between said first bail and said second bail to spread said first end (62) of said first bail from said first end (62) of said second bail.

5. The method of claim 1 further comprising the step of, remotely actuating a connector assembly (64) to couple a power or control line to said at least one conduit (84).

6. A method for moving a tubular (52) comprising the steps of, holding said tubular with an elevator (50) designed and arranged for holding said tubular and having first and second elevator ears (54) extending therefrom, coupling a first end (62) of a first bail (56) to said first elevator ear, coupling a first end (62) of a second bail (56) to said second elevator ear, remotely actuating a first bail locking apparatus (60) by which said first bail is locked to said first elevator ear, remotely actuating a second bail locking apparatus (60) by which said second bail is locked to said second elevator ear, and then simultaneously moving said first and second bails in a common direction, wherein the step of remotely actuating a first bail locking apparatus (60) further comprises the step of drawing a first jaw (72) and a second jaw (74) together around a portion (70) of said first elevator ear.

7. An apparatus comprising, a hoist (58), a first bail (56) having a first end (62) and a second end (63), said second end of said first bail coupled to said hoist, a second bail (56) having a first end (62) and a second end (63), said second end of said second bail coupled to said hoist, a first bail locking mechanism (60) carried by said first end of said first bail and designed and arranged to secure said first end of said first bail to a first elevator ear (54) of an elevator (5O), a second bail locking mechanism (60) carried by said first end of said second bail and designed and arranged to secure said first end of said second bail to a second elevator ear (54) of said elevator, at least one conduit (84) disposed in said first elevator ear (54), and a connector apparatus (64) designed and arranged for coupling to said at least one conduit and coupled to said first bail locking apparatus (60).

8. The apparatus of claim 7 further comprising, a spreading mechanism (78) coupled between said first bail (56) and said second bail (56) and designed and arranged to spread said first end (62) of said first bail from said first end (62) of said second bail.

9. The apparatus of claim 7 wherein said first bail locking mechanism (60) comprises, a frame (89) connected to said first end of said first bail, a first jaw (72) movably coupled to said frame, a second jaw (74) coupled to said frame, and an actuator (105) operatively coupled between said first jaw and said second jaw and designed and arranged to move said first jaw into and out of engagement with said second jaw.

10. The apparatus of claim 9 wherein, said frame (89) comprises a clamp (132) designed and arranged for coupling said frame to said first bail (56), a generally planar back plate (90) having an aperture (94) therethrough, and first and second generally planar side plates (92) connected to said back plate, said first jaw (72) is slideably coupled between said first and second side plates (92) and characterized by forming a first clamping surface (142), and said second jaw (74) is slideably coupled between said first and second side plates and characterized by forming a second clamping surface (144), wherein said first and second clamping surfaces are designed and arranged to clamp about a portion of said first elevator ear.

11. The apparatus of claim 10 wherein, said first jaw is fixed with respect to said second jaw in all but one axis of travel, and said first and second jaws collectively pivot between said first and second side plates.

12. The apparatus of claim 7 wherein said connector apparatus (64) comprises, an outer cylinder (118), an inner cylinder (116) having at least one longitudinal passage disposed therein which is designed and arranged to mate with said at least one conduit (84), said inner cylinder being axially slideably and rotatably disposed in said outer cylinder, and a piston (120) coupled to said inner cylinder (116) and designed and arranged to move said inner cylinder into and out of engagement with said at least one conduit (84).

13. In an elevator (50) for holding a tubular (52), the improvement comprising, first and second elevator ears (54), each of said elevator ears being designed and arranged to couple with a bail (56) and characterized by being generally cylindrical in shape, having a concave surface designed and arranged to seat an inner surface of an eye (62) of said bail, and having a longitudinally protruding nipple (70) which is designed and arranged to receive a clamping device (60), wherein said clamping device prevents said bail from uncoupling from said elevator ear.

14. The elevator of claim 13 wherein, each of said nipples is characterized by being generally cylindrically shaped and having a region with an enlarged diameter (82) disposed at a distal end.

15. The elevator of claim 13 further comprising, at least one conduit disposed in said first elevator ear having a first end disposed at a surface (86) of said first elevator ear and designed and arranged to supply power or control to said elevator.

16. A bail locking apparatus (60) comprising, a frame (89) designed and arranged to be attached to a bail (56), first and second jaws (72, 74) movably coupled to said frame and designed and arranged to clamp to a portion of an elevator ear (54), and an actuator (105) operatively coupled to said first and second jaws and designed and arranged to move said first and second jaws into clamping engagement with said portion of said elevator ear, said actuator being designed and arranged for remote actuation.

17. The apparatus of claim 16 wherein said frame (89) comprises, a mount (132) designed and arranged for coupling said frame to said bail (56), a back plate (90), and first and second generally planar side plates (92) connected to said back plate, said first and second side plate having a plurality of generally vertical slots formed therein for confining movement of said first and second jaws, wherein said first jaw (72) is slideably coupled between said first and second side plates (92) and characterized by having a surface (142) with a first clamping profile, and said second jaw is slideably coupled between said first and second side plates and characterized by having a surface (144) with a second clamping profile.

18. The apparatus of claim 17 further comprising, a plurality of cross slots (102) formed in said first and second side plates disposed at intersections with said plurality of generally vertical slots and oriented at angles thereto, said plurality of cross slots designed and arranged for allowing said first jaw (72) and said second jaw (74) to pivot with respect to said frame (89), and at least one guide (104) slideably coupled between said first and second jaws and designed and arranged for preventing said first jaw from pivoting with respect to said second jaw.

19. A multi-coupling system connector apparatus (64) comprising, a frame (89) designed and arranged to be mounted to a bail (56) supporting an elevator (50) at an elevator ear (54), a connector assembly (116) coupled to said frame and designed and arranged to mate with at least one conduit (84) terminating at a surface (86) of said elevator ear (54), and an actuator designed and arranged for coupling and uncoupling said connector assembly (116) with said at least one conduit.

20. The apparatus of claim 19 further comprising, an outer cylinder (118) which slideably captures said connector assembly (116), wherein said actuator includes a piston (120) coupled to said connector assembly (116) and is designed and arranged to slide said connector assembly longitudinally in said outer cylinder.

21. The apparatus of claim 19 wherein, said connector assembly (116) is characterized by having a longitudinal axis and is designed and arranged to rotate about said axis with respect to said frame (89).

* * * * *